US010300320B2

(12) United States Patent
Pallesen et al.

(10) Patent No.: US 10,300,320 B2
(45) Date of Patent: May 28, 2019

(54) AQUA EXERCISE EQUIPMENT

(71) Applicant: AQUASTRENGTH LIMITED, Auckland (NZ)

(72) Inventors: John Douglas Pallesen, Auckland (NZ); Troy Jonathon Elliott, Auckland (NZ); Richard Alexander Pallesen, Warkworth (NZ)

( * ) Notice: Subject to any disclaimer, the term of this patent is extended or adjusted under 35 U.S.C. 154(b) by 92 days.

(21) Appl. No.: 15/528,262

(22) PCT Filed: Nov. 24, 2015

(86) PCT No.: PCT/IB2015/059056

§ 371 (c)(1),
(2) Date: May 19, 2017

(87) PCT Pub. No.: WO2016/083984

PCT Pub. Date: Jun. 2, 2016

(65) Prior Publication Data

US 2017/0361144 A1 Dec. 21, 2017

Related U.S. Application Data

(60) Provisional application No. 62/083,526, filed on Nov. 24, 2014.

(51) Int. Cl.
*A63B 21/00* (2006.01)
*A63B 22/00* (2006.01)
(Continued)

(52) U.S. Cl.
CPC ..... *A63B 21/0084* (2013.01); *A63B 21/0004* (2013.01); *A63B 21/0602* (2013.01);
(Continued)

(58) Field of Classification Search
CPC ..... A63B 21/0004; A63B 21/0084; A63B 21/0602; A63B 21/0606; A63B 21/068;
(Continued)

(56) References Cited

U.S. PATENT DOCUMENTS 4,311,306 A * 1/1982 Solloway ..... A63B 21/0084 482/108
D299,365 S * 1/1989 Greeley ..... D21/678
(Continued)

FOREIGN PATENT DOCUMENTS

FR 2926469 A1 7/2009
GB 2487231 A 7/2012

OTHER PUBLICATIONS

WIPO, International Preliminary Report on Patentability, Appln. No. PCT/IB2015/059056, May 30, 2017, pp. 1-8.
(Continued)

*Primary Examiner* — Joshua Lee
(74) *Attorney, Agent, or Firm* — Dann, Dortman, Herrell and Skillman, P.C.

(57) ABSTRACT

An aqua resistance dumbbell comprises a tubular wall that provides a bore for receiving a user's hand from each end of the bell. A rod is located within the bore and extending laterally across the bore to be gripped by a user with one or both hands from one or both ends of the bore. The dumbbell has a plurality of longitudinal fins extend along the tubular wall on an outer side of the tubular wall, and at least one lateral fin that extends laterally at least part way around the tubular wall. An aqua resistance fin assembly comprises two fin components and at least one fastening member for fitting the fin components to a user's limb in a side-by-side configuration around the limb. Each fin component comprises a base adapted to fit against a user's limb and adapted to be secured to the user's limb by the fastening member,
(Continued)

and at least two longitudinal fins and at least one lateral fin on an outer side of the base.

20 Claims, 10 Drawing Sheets

(51) Int. Cl.

| | |
|---|---|
| ***A63B 21/008*** | (2006.01) |
| ***A63B 21/068*** | (2006.01) |
| ***A63B 21/072*** | (2006.01) |
| ***A63B 23/035*** | (2006.01) |
| ***A63B 21/06*** | (2006.01) |

(52) U.S. Cl.
CPC ..... *A63B 21/0606* (2013.01); *A63B 21/068* (2013.01); *A63B 21/0726* (2013.01); *A63B 21/4011* (2015.10); *A63B 21/4017* (2015.10); *A63B 21/4025* (2015.10); *A63B 21/4035* (2015.10); *A63B 22/0007* (2013.01); *A63B 23/03508* (2013.01); *A63B 23/03516* (2013.01); *A63B 23/03541* (2013.01); *A63B 23/03525* (2013.01); *A63B 2022/0035* (2013.01); *A63B 2022/0038* (2013.01); *A63B 2022/0041* (2013.01); *A63B 2225/01* (2013.01); *A63B 2225/60* (2013.01); *A63B 2225/605* (2013.01)

(58) Field of Classification Search
CPC ..... A63B 21/0726; A63B 21/4011; A63B 21/4017; A63B 21/4025; A63B 21/4035; A63B 22/0007; A63B 23/03508; A63B 23/03516; A63B 23/03525; A63B 23/03541; A63B 2022/0035; A63B 2022/0038; A63B 2022/0041; A63B 2225/01; A63B 2225/60; A63B 2225/605
See application file for complete search history.

(56) References Cited

U.S. PATENT DOCUMENTS

| | | | | | |
|---|---|---|---|---|---|
| 4,819,951 | A * | 4/1989 | Solloway | A63B 21/0084 | 482/111 |
| 4,902,005 | A | 2/1990 | McNeill | | |
| 5,033,739 | A * | 7/1991 | MacKechnie | A63B 21/0084 | 482/111 |
| D344,113 | S * | 2/1994 | Shelton | D21/678 | |
| 5,531,657 | A * | 7/1996 | Macedo | A63B 21/0084 | 482/106 |
| 6,436,014 | B1 * | 8/2002 | Cirjak | A63B 21/0606 | 446/26 |
| 7,621,851 | B2 * | 11/2009 | Stout | A63B 21/0004 | 482/55 |
| 8,790,224 | B1 * | 7/2014 | Davis | A63B 21/0084 | 441/50 |
| 2002/0098952 | A1 * | 7/2002 | Stout | A63B 21/0084 | 482/55 |
| 2004/0259691 | A1 * | 12/2004 | Stout | A63B 21/0084 | 482/47 |

OTHER PUBLICATIONS

EPO, Extended European Search Report, Appln. No. EP 15863002.0, Aug. 9, 2018, pp. 1-9.
Applicant, Response to EP Communication, Appln. No. EP 15863002.0, Dec. 18, 2018, pp. 1-6.

* cited by examiner

AQUA EXERCISE EQUIPMENT

FIELD OF THE INVENTION

The present invention relates to aqua exercise equipment, and specifically to aqua dumbbells and leg fin devices providing water resistance for exercise.

BACKGROUND TO THE INVENTION

Aquatic exercise such as aqua aerobics may be performed for improving or maintaining fitness or for rehabilitation, for example from injury. Land based exercise can involve high stresses on muscles and joints due to gravity, for example when running or jumping. Exercising in water can avoid such stresses due to the buoyancy force provided by the water counteracting a person's body weight. Thus aqua exercise may be particularly attractive to the elderly or overweight people, or to people recovering from injury or requiring physical rehabilitation, as the water supports the person during exercise.

Such benefits of exercising in water are advantageous to people of all ages and levels of fitness, including healthy and athletic people. Exercising in water may also be particularly useful to those who have a high level of fitness as water provides resistance against movement that is proportional to the effort exerted in movement. Moving quickly in water increases the amount of resistance acting on a person's body many times more than resistance due to air when performing the same motion on land.

The use of aqua resistance equipment may be used to increase the resistance that water provides against a user's movement in water to improve strength and aerobic fitness and other related benefits, while avoiding land based disadvantages caused by gravity acting on the body when performing exercises.

Aqua exercise resistance equipment may be difficult to use. For example aqua exercise resistance equipment may not provide a correct level of resistance against movement in water. Furthermore, aqua exercise resistance equipment may provide an unbalanced or different level of resistance in opposite directions of movement which may be undesirable. Additionally, for balanced exercises in water it may be preferred to have equipment that may be gripped by both hands or easily passed from one hand to the other.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved aqua exercise device or to at least provide the industry or the public a useful choice.

SUMMARY OF THE INVENTION

In one aspect, the present invention consists in an aqua resistance dumbbell comprising:

- a tubular wall providing a bore for receiving a user's hand from each end of the bell,
- a rod located within the bore and extending laterally across the bore to be gripped by a user with one or both hands from one or both ends of the bore,

- a plurality of longitudinal fins extending along the tubular wall on an outer side of the tubular wall, and at least one lateral fin on the outer side of the tubular wall, the lateral fin extending laterally at least part way around the tubular wall.

In some embodiments the longitudinal fins extend substantially radially with respect to a longitudinal axis of the bore. In some embodiments the longitudinal fins are aligned substantially parallel to a longitudinal axis of the bore. In some embodiments the longitudinal fins extend outwardly from an outer surface of the tubular wall.

In some embodiments an inner surface of the bore is substantially smooth without fins to provide a substantially unobstructed bore for receiving a user's hand from both ends. In some embodiments the tubular wall is without holes in a lateral centre region of the tubular wall. In some embodiments the lateral centre region of the bell extends for at least 50% of the length of the tubular wall.

In some embodiments the rod is located substantially on a lateral centre line of the dumbbell.

In some embodiments an inner surface of the tubular wall generally slopes inwardly towards the lateral centre line of the dumbbell, such that an internal lateral dimension of the bore at the lateral centre line of the bell is smaller than at ends of the bore.

In some embodiments the lateral fin or fins extend laterally fully around the tubular wall. In some embodiments each lateral fin bridges between adjacent longitudinal fins.

In some embodiments a plurality of openings is provided around the tubular wall between the lateral fin and the outside of the tubular wall. In some embodiments an opening is provided between each lateral fin and an outside surface of the tubular wall between each pair of adjacent longitudinal fins. In some embodiments each opening spans substantially fully between adjacent longitudinal fins.

In some embodiments the dumbbell comprises two lateral fins spaced axially apart along the longitudinal axis of the bore, one said lateral fin on one side of a lateral centre line of the dumbbell and the other said lateral fin on an opposite side of the lateral centre line. In some embodiments each lateral fin positioned adjacent an end of the dumbbell.

In some embodiments the two lateral fins and two adjacent longitudinal fins provide a boundary wall to define a containment volume at an outer surface of the tubular wall, the plurality of longitudinal fins and spaced apart lateral fins defining a plurality of containment volumes spaced apart around the tubular wall.

In some embodiments the lateral fins are angled inwardly towards a lateral centre line of the bell. In some embodiments an angle between each lateral fin and an outer surface of the tubular wall is about 40 to 80 degrees, or about 45 to 75 degrees or about 50 degrees to 70 degrees.

In some embodiments an outer surface of the tubular wall generally slopes inwardly towards the lateral centre line of the dumbbell.

In some embodiments the tubular wall of the dumbbell comprises holes adjacent each end of the dumbbell spaced apart around the perimeter wall.

In some embodiments the rod is hollow with openings to allow water to flood into an inside of the rod.

In some embodiments the lateral cross section of the tubular perimeter wall is circular or a regular polygon having at least four sides.

In some embodiments an overall length of the tubular wall is similar to a maximum diameter or lateral dimension of the bore.

In some embodiments the lateral cross section of the tubular wall is regular polygon having at least four sides and the longitudinal fins extend from corners of the tubular wall.

In some embodiments the bell comprises at least four longitudinal fins, or five or six or seven or eight longitudinal fins. In some embodiments the longitudinal fins are equispaced around the tubular wall.

In some embodiments the tubular wall has a length of about 50 mm to 250 mm, or about 80 mm to 220 mm, or about 100 mm to 200 mm, or about 130 mm to 170 mm.

In some embodiments the bore has a minimum lateral dimension of greater than 120 mm. In some embodiments the bore has a maximum lateral dimension of about 130 mm to 250 mm or about 140 mm to 200 mm, or about 150 mm to 180 mm.

In some embodiments the longitudinal fins extend the full length of the tubular wall. In some embodiments the longitudinal fins have a height of about 20 mm to 60 mm, or about 30 mm to 50 mm. In some embodiments the lateral fins have a height of about 15 mm to 50 mm or about 20 mm to 40 mm.

In some embodiments the opening has a maximum height of about 5 mm to 20 mm, or about 10 mm to 20 mm, or about 15 mm.

In some embodiments the bell is formed from two identical end parts that mate or join together on a lateral centre line of the bell.

In some embodiments the lateral fins are symmetrical with respect to a plane of symmetry located at a lateral centre line of the bell extending perpendicular to the longitudinal axis of the bell.

In another aspect, the present invention consists in an aqua resistance fin assembly adapted to be fitted to a user's limb comprising:

two fin components and at least one fastening member for fitting the fin components to a user's limb in a side-by-side configuration around the limb, each fin component comprising:

a base adapted to fit against a user's limb and adapted to be secured to the user's limb by the fastening member, and at least two longitudinal fins and at least one lateral fin on an outer side of the base, the longitudinal fins to extend along the user's limb and the lateral fin extending lateral to the longitudinal fins.

In some embodiments the fin components are moveable on the fastening member to set the relative position of the two fin components around the user's limb.

In some embodiments the fastening member is a strap to pass around a user's limb and comprises fasteners for ensuring ends of the strap together.

In some embodiments the fasteners are hook and loop fasteners, for example Velcro®.

In some embodiments the base of each fin component comprises slots for receiving the strap to secure the fin component to the user's limb.

In some embodiments the base comprises a said slot adjacent each longitudinal edge of the fin component.

In some embodiments the base of the fin component extends laterally outside the longitudinal fins such that longitudinal fins are located inside of a longitudinal edge of the base, and the slots are position in the base laterally outside of the longitudinal fins.

In some embodiments the base of each fin component is secured to the user's limb substantially against movement relative to the user's limb in use.

In some embodiments the base is adapted to extend around the limb by less than 180 degrees.

In some embodiments the longitudinal fins extend outwardly from the base approximately radially relative to an axis that extends along the user's limb.

In some embodiments the longitudinal fins converge from one end of the base to an opposite end of the base, and the distance from the base to the axis reduces from the one of the base to the opposite end of the base.

In some embodiments the axis extends approximately along a centre of curvature of the base of the fin component.

In some embodiments the axis is closer to the base than a centre of curvature of the base.

In some embodiments the longitudinal fins extend radially from the axis with an angle between the longitudinal fins of between 40 and 80 degrees, or between 50 and 70 degrees.

In some embodiments the longitudinal fins extend approximately radially from the base.

In some embodiments the longitudinal fins are arranged to be positioned within an arc length subtending an angle of less than 90 degrees with respect to an approximate longitudinal centreline of the user's limb.

In some embodiments the longitudinal fins are arranged to be positioned within an arc length subtending an angle of 30 degrees to 90 degrees, or 40 to 80 degrees, or 50 to 70 degrees with respect to an approximate longitudinal centreline of the user's limb.

In some embodiments the longitudinal fins converge from one end of the base to another end of the base.

In some embodiments the angle of convergence is about 6 degrees to 16 degrees, or about 8 degrees to 14 degrees or about 10 degrees to 12 degrees.

In some embodiments the fin component is symmetrical with respect to a plane of symmetry located at a longitudinal centre line of the fin component.

In some embodiments the longitudinal fins are laterally spaced apart at the base of the fin component.

In some embodiments the fin component comprises one or more longitudinal fins positioned in between the two longitudinal fins.

In some embodiments the fin component comprises two lateral fins spaced axially apart along the longitudinal axis of the fin component.

In some embodiments each lateral fin bridges between two longitudinal fins.

In some embodiments an opening is provided between the lateral fin and an outer surface of the base of the fin component.

In some embodiments the opening spans substantially fully between adjacent longitudinal fins.

In some embodiments the fin component comprises two lateral fins spaced axially apart along the longitudinal axis of the fin assembly.

In some embodiments each lateral fin positioned adjacent an end of the fin assembly.

In some embodiments the two lateral fins and two longitudinal fins provide a boundary wall to define a containment volume at an outer surface of the base.

In some embodiments the lateral fins are substantially parallel and perpendicular to a longitudinal centerline of the fin component.

In some embodiments the fin assembly comprises a cushion, the fin component moveably attached to the cushion.

In some embodiments the fin components are attached to the cushion by the fastening member.

In some embodiments the cushion is a neoprene cushion with a thickness of 5 mm to 20 mm, or 5 mm to 15 mm or 7 mm to 13 mm.

In some embodiments the fin component is about 100 to 200 mm long.

In some embodiments the two longitudinal fins are spaced apart by a maximum lateral spacing of about 40 mm to 60 mm or about 50 mm to 60 mm at one end of the fin component at an outer surface of the base.

In some embodiments the longitudinal fins have a height of about 20 mm to 100 mm, or about 30 mm to 80 mm or about 30 mm to 70 mm.

In some embodiments the lateral fins have a height of about 15 mm to 40 mm or about 20 mm to 30 mm.

In some embodiments the opening has a maximum height of about 5 mm to 30 mm, or about 10 mm to 25 mm.

In some embodiments the fin components are adapted to be arranged on opposite sides of the user's limb.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1A:
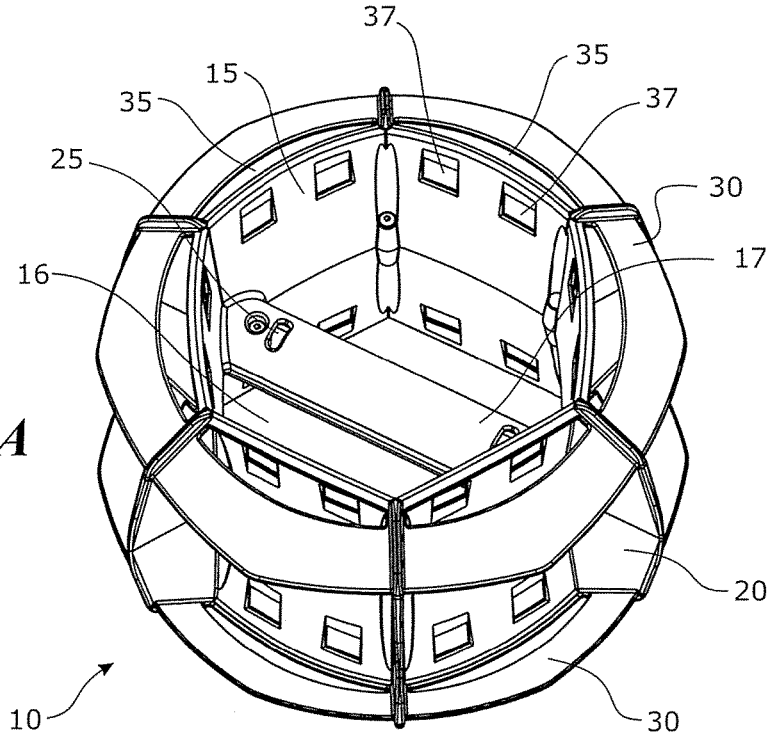
FIG. 1A is a perspective view of a dumbbell according to an embodiment of one of the present inventions.

An aqua dumbbell or 'bell' according to some embodiments of one of invention is illustrated in FIGS. 1 to 6. The bell 10 may be gripped by a user by either hand and used for resistance training or exercise in water. The bell is particularly useful for strengthening or otherwise conditioning a person's upper body, and for improving aerobic conditioning, cardiovascular endurance and increasing flexibility.

A bell 10 according to the present invention comprises a tubular wall 15 providing a bore 16. Located within the bore is rod 17 extending laterally across the bore. The rod forms a handle to be gripped by a user by the hand. Preferably the rod is located substantially on a lateral centre line of the dumbbell. The bore is open at both ends so that the handle of the bell can be gripped inside the tubular bore 16 from either end of the bell. As the bell may be gripped from either end by either hand, the bell is particularly useful for aquatic exercise. The user may easily pass the bell from hand to hand during exercise. Furthermore, a user may grip the handle 17 with both hands, each hand via one end of the bell, or by both hands from one end of the bell. For example a user may grip the rod 17 with one hand from one end of the bell and with the other hand grip the rod and first hand from the other end of the bell, so that both hands are holding around the handle and within the bore 16. Alternatively a user may grip the rod 17 with one hand from one end of the bell and with the other hand grip the rod and first hand from the same end of the bell. A double handed grip within the bore of the bell allows the bell to be used not only for arm movement or arm thrusting exercises in the water, but also for upper body exercises such as bending or twisting from the waist to work the upper body. When gripping the rod 17 with one hand from one end of the bell and with the other hand grip from the other end of the bell, a user can securely hold the bell with both hands, for example in front of or against the torso and perform upper body twisting exercises to strengthen or otherwise condition the upper body. When gripping the rod by both hands from one end of the bell, the rod may be gripped in the same way a user grips the handle of other sporting equipment such as baseball bats, cricket bats and golf clubs. Thus a user can use the bell in water for resistance training related to such sports.

Figure 4:
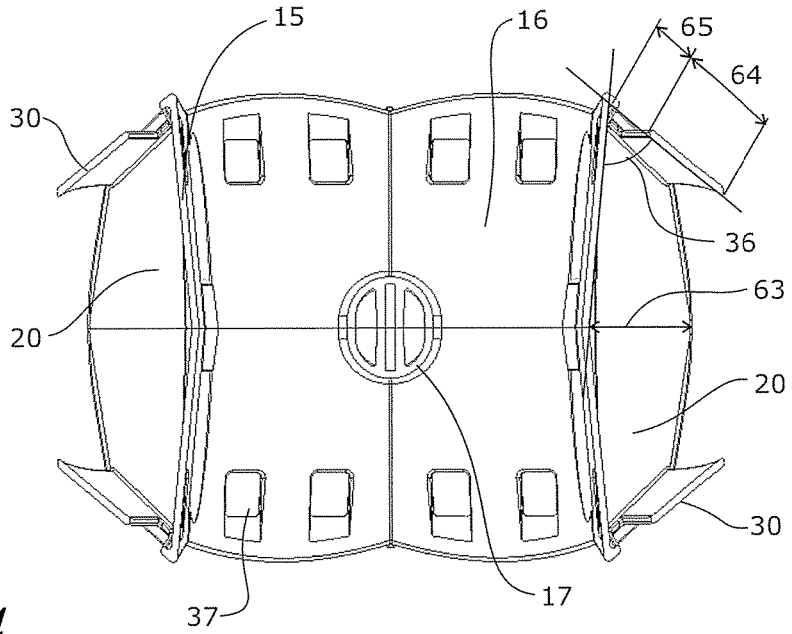
FIG. 4 is a lateral cross sectional view of the dumbbell of FIG. 1A.

In some embodiments an inner surface of the bore is substantially smooth without fins to provide a substantially unobstructed bore for receiving a user's hand or hands from both ends. In some embodiments, to assist with inserting hands into the bore of the bell an inner surface of the tubular wall generally slopes inwardly towards a lateral centre line of the dumbbell, such that an internal lateral dimension of the bore at the lateral centre line of the bell is smaller than at ends of the bore. That is each end of the tubular bore may act as a guiding surface or funnel towards the lateral centre line of the bell for receiving a user's hand through to the centrally located rod. In FIG. 4 the tubular wall 15 is shown in cross section along the bore 16 and shows each half of the wall sloping inwards to the centre line of the bore. In some embodiments each half of the tubular wall may be frusto-conical.

For resistance to movement in water transverse or lateral to the longitudinal axis of the bell, the bell comprises a plurality of longitudinal fins positioned outside the tubular wall. In some embodiments the longitudinal fins 20 are aligned substantially parallel to a longitudinal axis 18 of the bore 17 and tubular wall 15. In some embodiments, as illustrated the longitudinal fins 20 extend substantially radially with respect to the axis 18 of the bore. In the illustrated embodiment the bell comprises six longitudinal fins. However, there are preferably at least four longitudinal fins, and could have five, six, seven, eight or more longitudinal fins. The longitudinal fins are spaced apart around the outside of the tubular wall. Preferably there is an even number of longitudinal fins spaced apart around the outside of the tubular wall. In a most preferred embodiment the longitudinal fins are equi-spaced around the tubular wall. In some embodiments the longitudinal fins extend the full length of the tubular wall. In some embodiments the longitudinal fins have a larger width at a lateral centre of the bell than at ends of the bell, as illustrated.

The tubular wall 15 provides a surface area of the bell that provides a resistance to movement transverse or lateral to the longitudinal axis of the bell. The longitudinal fins provide additional resistance to movement transverse or lateral to the longitudinal axis 18 of the bell. Furthermore, the longitudinal fins provide resistance to rotational movement of the bell on the longitudinal axis of the bell. For example, when a user holds the bell by the rod 17 the longitudinal axis of the bell runs substantially along the user's forearm. A user may rotate the user's wrist on the longitudinal axis to work the user's forearm. The particular configuration of the bell comprising the tubular wall and longitudinal fins is useful for movement of the bell in a circular motion on plane lateral to the longitudinal axis of the bell. For example, when the bell is held by both hands, each hand from each end of the tubular wall, the bell may be moved in a circular motion on the sagittal plane of the user. This works both arms of the user in a balanced way at the same time. Alternatively a user may grip a bell in each hand and move in a circular motion on a plane approximately on a lateral plane of the bell.

As illustrated, in preferred embodiments the longitudinal fins are spaced apart fully along the tubular wall. In some embodiments the longitudinal fins are parallel such that the longitudinal fins provide no or very minimal resistance to movement of the bell along the longitudinal axis of the bell. The tubular wall may provide no or very minimal resistance to movement of the bell along the longitudinal axis of the bell. Importantly, the bell comprising the tubular wall forming a tubular bore open at each end provides for the same resistance when moving the bell in either direction along the longitudinal axis. Furthermore with the longitudinal fins aligned parallel to the longitudinal bore of the bell, the bell provides for the same resistance for movement in either direction along the longitudinal axis. For example, the bell provides the same resistance when pushing or punching the bell forwardly away from a user's body as the resistance when pulling the bell back towards the user's body. A balanced amount of resistance in each direction of the axis of the bell is desirable.

In the illustrated embodiment the longitudinal fins extend outwardly from an outer surface of the tubular wall. In some embodiments the longitudinal fins may be spaced from the outer surface of the tubular wall. For example the fins could be supported on posts extending from the tubular wall.

The bell comprises at least one lateral fin to provide for resistance to movement in a direction along the longitudinal axis of the bell, for example in a punching motion. Preferably the lateral fin or fins are arranged to provide for balanced amount of resistance in each direction along the longitudinal axis. That is, the lateral fin or fins provide for the same amount of resistance in each direction along the longitudinal axis. For example, in the preferred embodiment the bell comprises two spaced apart lateral fins 30 as illustrated. The lateral fins are symmetrical with respect to a plane of symmetry located at a lateral centre line 21 of the bell extending perpendicular to the longitudinal axis of the bell. Alternatively, the bell may comprise one lateral fin, for example a fin that is positioned approximately on a lateral centre line of the bell arranged approximately perpendicular to the longitudinal axis of the bell.

In preferred embodiments the configuration of the tubular wall, longitudinal fins and the lateral fin or fins provide for bi-directional balanced movement of the bell along the longitudinal axis. Furthermore, the configuration of the tubular wall, longitudinal fins and the lateral fin or fins provide for bi-directional balanced movement of the bell in directions perpendicular to the longitudinal axis of the bell. Additionally, the configuration of the tubular wall, longitudinal fins and the lateral fin or fins provide for bi-directional balanced rotation of the bell on the longitudinal axis of the bell.

Figure 3:
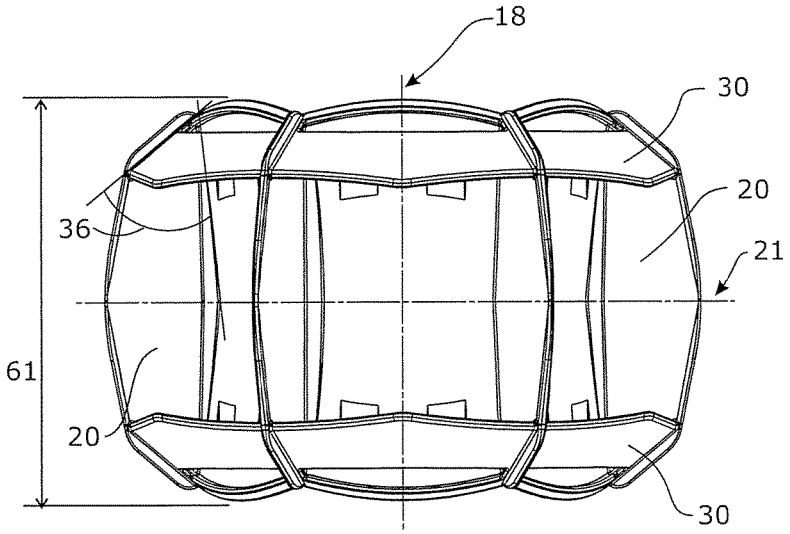
FIG. 3 is a side view of the dumbbell of FIG. 1A.
Figure 6:
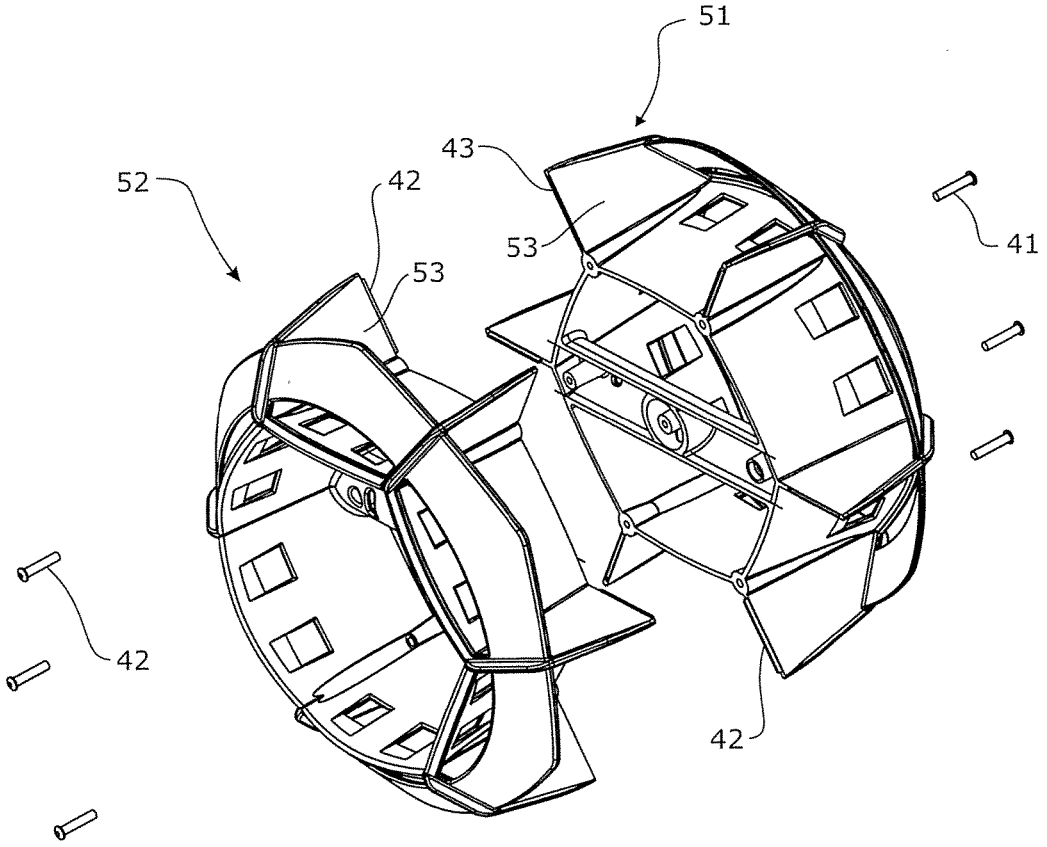
FIG. 6 is an exploded view of the dumbbell of FIG. 1A showing two halves of the bell and fasteners for securing the halves together to form the dumbbell assembly.
Figure 7A:
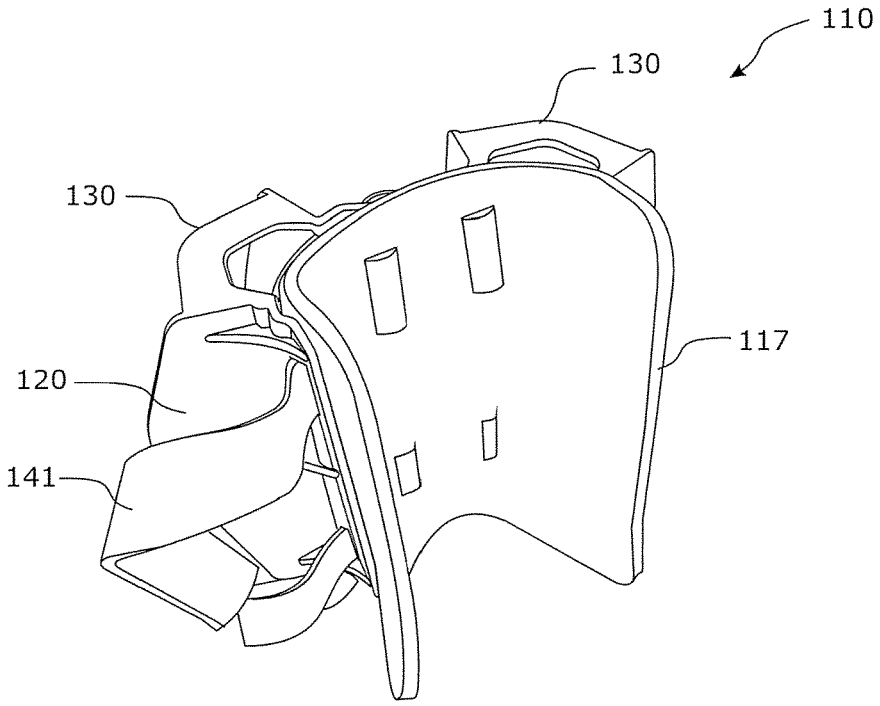
FIG. 7A illustrates a leg fin assembly according to an embodiment of one of the present inventions from an inner side of the assembly.
Figure 7B:
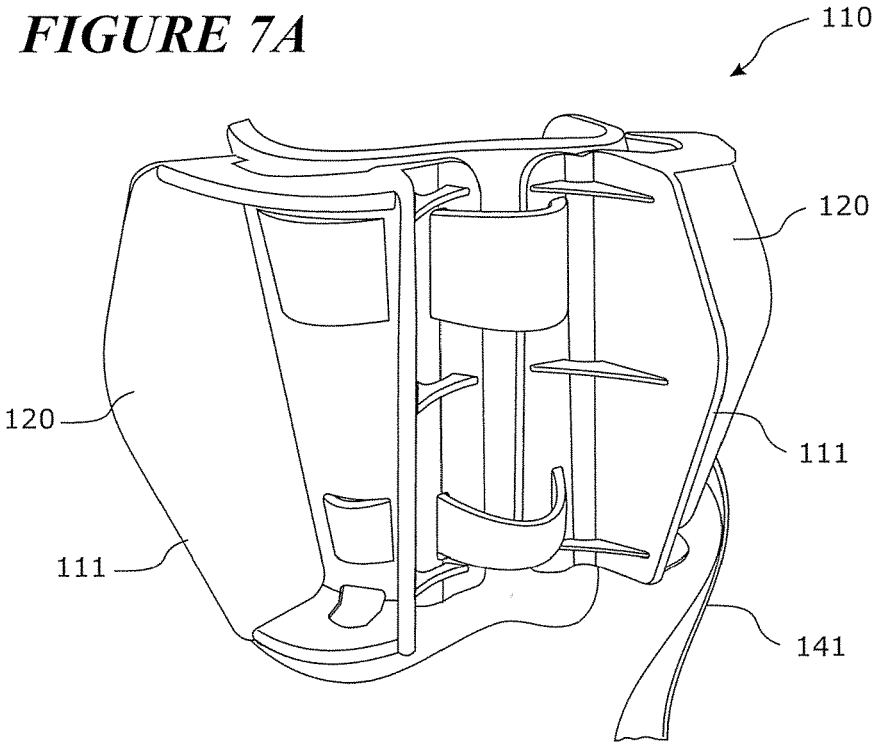
FIG. 7B illustrates the leg fin assembly of FIG. 7A from an outer side of the assembly.

As illustrated in FIG. 3, preferably one half of the bell on one side of a lateral centre line 21 perpendicular to the longitudinal axis 18 of the bell is substantially identical to the other half of the bell on the other side of the lateral centre line. Preferably one half of the bell on one side of a longitudinal centre line 22 of the bell passing along the rod 17 is substantially identical to the other half of the bell on the other side of the longitudinal centre line 22 passing along the rod 17. Preferably one half of the bell on one side of a longitudinal centre line 23 of the bell passing across the rod 17 is substantially identical to the other half of the bell on the other side of the longitudinal centre line 23 passing across the rod 17. In some embodiments the bell is formed from two identical end parts that mate or join together on a lateral centre line of the bell along the rod, for example parts 51 and 52 as shown in FIG. 6. This assists to reduce manufacturing complexity and cost. As shown in FIGS. 3 and 6, the two halves are held together using screw fasteners, one set of screw fasteners from one side of the bell and a second set of screw fasteners from an opposite side of the bell. In some embodiments each bell half has a key 42 or keyway 43 formed at each lateral centre end 53 of the longitudinal fin half to match a corresponding keyway 43 or key 42 in the corresponding longitudinal fin half. The key and keyways mate to ensure the centre of each fin 20 does not flex at the joint between each bell half 51, 52. At least a portion of the longitudinal fins, lateral fins and tubular wall are integrally formed. The relative positions of the longitudinal fins 20, lateral fins 30 and tubular wall 15 are fixed.

Figure 5:
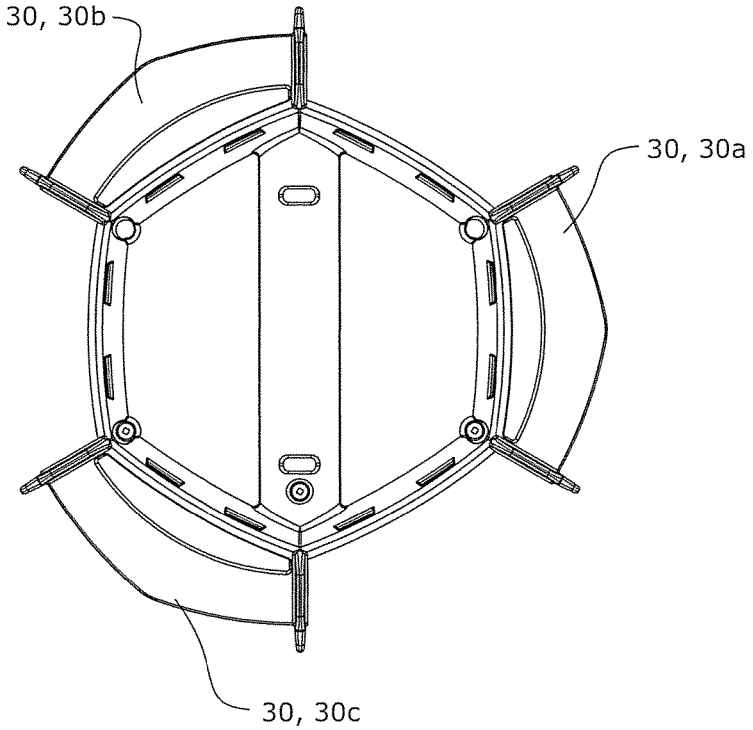
FIG. 5 is an end view of an alternative dumbbell according to an embodiment of one of the present inventions.

In some embodiments, as illustrated the lateral fin or fins extend laterally fully around the tubular wall. That is, the fins extend continuously around the outside of the tubular wall, for example as illustrated in FIGS. 1A to 4. In alternative embodiments, the lateral fin may not extend fully around the wall. For example, a lateral fin may comprise segments spaced apart around the outside of the tubular wall. For example, as illustrated in FIG. 5, in some embodiments the bell may have a lateral fin 30 comprising spaced apart fin segments 30*a*, 30*b*, 30*c*.

Figure 1B:
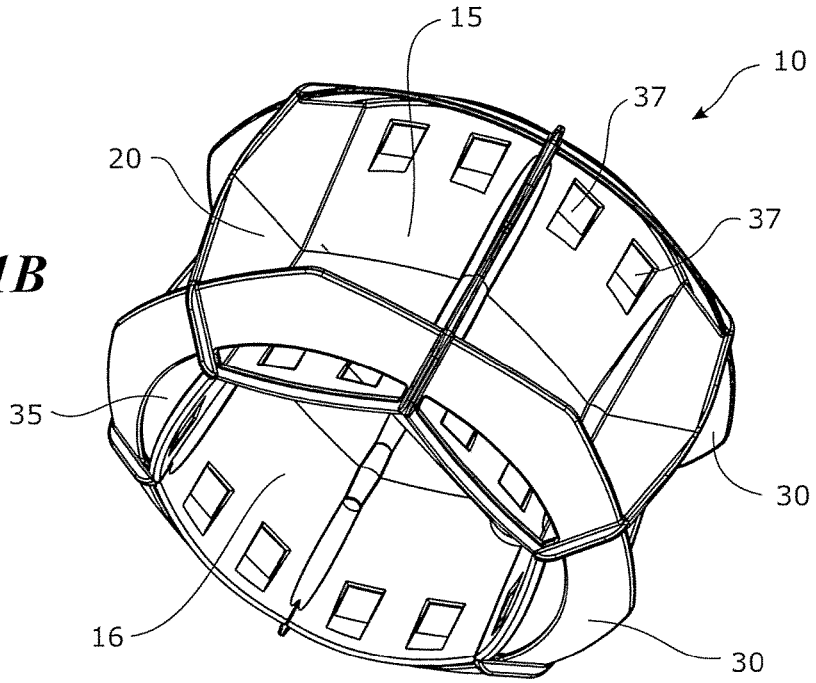
FIG. 1B is another perspective view of the dumbbell of FIG. 1B.
Figure 2:
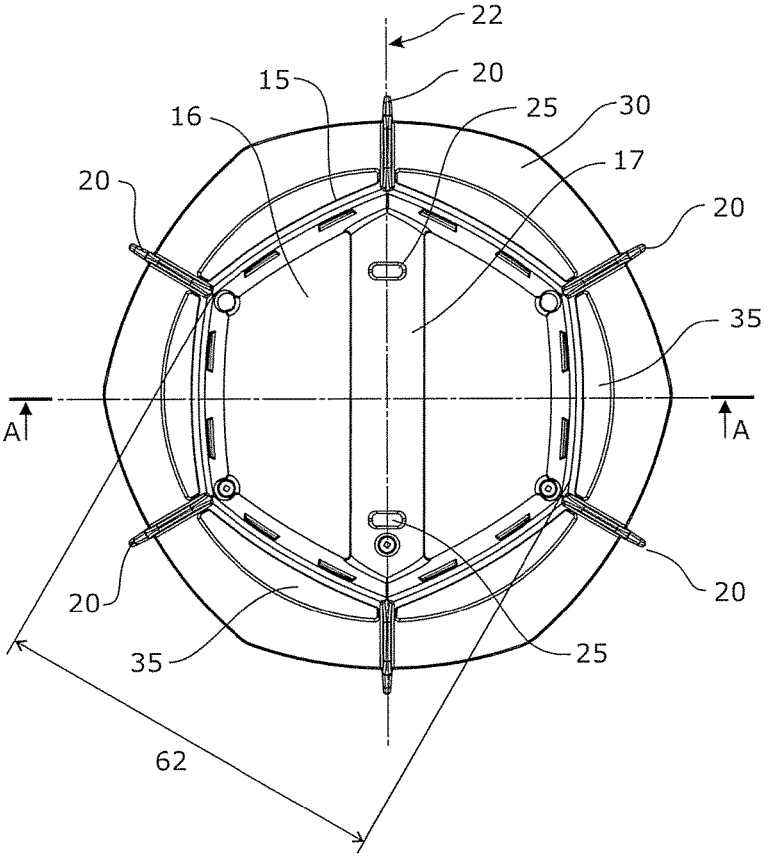
FIG. 2 is an end view of the dumbbell of FIG. 1A.

In some embodiments each lateral fin 30 bridges between adjacent longitudinal fins, for example as shown in FIGS. 1A and 1B.

In some embodiments, a plurality of openings 35 is provided around the tubular wall between the lateral fin and the outside of the tubular wall. In some embodiments, an opening 35 is provided between each lateral fin 30 and an outside surface of the tubular wall 15 between each pair of adjacent longitudinal fins 20. As shown, in some embodiments each opening spans substantially fully between adjacent longitudinal fins. In use, when the dumbbell is moved along the longitudinal axis, or longitudinally with respect to the longitudinal axis, the lateral fins provide resistance. However, openings 35 allow water to pass the lateral fin on either side of the lateral fin on the outside of the tubular wall. Water passing through an opening 35 can flow down the outside of the tubular wall.

In some embodiments the dumbbell has two lateral fins 30 spaced apart axially apart along the longitudinal axis of the bore, as illustrated in the Figures. One lateral fin is on one side of a lateral centre line 21 of the dumbbell and the other lateral fin is positioned an opposite side of the lateral centre line 21. In some embodiments each lateral fin is positioned adjacent an end of the dumbbell. In some embodiments, as illustrated in the Figures, the lateral fins 30 are angled inwardly towards a lateral centre line 21 of the bell. The fin 30 may be angled inwards from the tubular wall towards the centre of the bell at an angle between the lateral fin and an outer surface of the tubular wall of about 40 to 80 degrees. This angle is identified as item 36 in FIG. 3. In some embodiments the angle 36 is between about 45 degrees to 75 degrees, or in some embodiments about 50 degrees to 70 degrees.

With two spaced apart lateral fins, the lateral fins and longitudinal fins provide a plurality of containment volumes at an outer surface of the tubular wall spaced apart around the tubular wall. Each containment volume is defined by a boundary wall formed by the two spaced apart lateral fins and two adjacent longitudinal fins. The containment volumes act to partially contain or hold a volume of water therein as the bell is moved through the water, to add resistance or weight to the movement. With the lateral fins angled inwards towards the lateral centre line of the bell, the effect of the lateral fins to retain or restrict a volume of water at the outer surface of the bell is increased. Where an opening 35 is provided between the lateral fin and outside of the tubular wall the angle of the lateral fin acts to shed water acting on an inner side of the lateral fin through the opening 35. Thus the angle of the lateral fin and the opening combine to regulate the amount of resistance or force opposing movement the bell through the water. Furthermore, an opening 35 at one end of the bell allows water to enter the containment volume and access the inner surface of the inwardly angled lateral fin at the opposite end of the bell.

The effect of the lateral fins may be improved by angling the fins inwards as described. Were the fins to be angled outwardly, movement of the bell through the water would cause the water to ride outwardly off the lateral fin at a rear end of the bell (relative to a direction of movement along the longitudinal axis) away from the outside of the tubular wall which may reduce the amount of resistance provided by the bell. Furthermore, angling the lateral fins outwardly may cause less stable movement of the bell through the water. By angling a lateral fin outwards, an outer edge of the lateral fin at a forward end of the bell (relative to a direction of movement along the longitudinal axis) presents forwardly which may cause less stable movement of the bell in water compared to having the fins angled inwardly. Having the fins angled inwardly means the lateral fin at a forward end of the bell is angled away from the forward end of the bell. The lateral fin at the rearward end of the bell presents an outer edge forwardly but the rearward lateral fin may have less effect on guiding the bell in the water. In other words, angling the lateral fins inwards may provide for a more stable movement of the bell in the water.

As explained above, the lateral fins and longitudinal fins provide a plurality of containment volumes at an outer surface of the tubular wall spaced apart around the tubular wall. The arrangement of fins 20, 30 relative to the outer surface of the tubular wall effects the movement of water at the outer surface of the tubular wall and therefore resistance to movement through the water. The arrangement of fins 20, 30 relative to the outer surface of the tubular wall and the openings 35 between the lateral fin and each pair of longitudinal fins effects the movement of water at the outer surface of the tubular wall and therefore resistance to movement through the water. Furthermore, in some embodiments, the tubular wall of the dumbbell comprises holes 37 adjacent each end of the dumbbell spaced apart around the perimeter wall. The inwardly angled lateral fins 30 may force water against the outer surface of the tubular wall during movement through water. Water that is forced against the outer surface of the wall by lateral fins may channel through the wall via the holes 37 near the ends of the wall. Thus the lateral fins and holes 37 combine to regulate the amount of resistance provided by the bell. The holes 37 may be located in the wall below the lateral fin such that the holes are obstructed from view when viewing the bell from a side of the bell, as shown in FIG. 3. The holes 37 near the ends of the tubular wall water allow water to pass through the wall near ends of the wall. In some embodiments, the tubular wall is without holes in a lateral centre region of the tubular wall. For example, the lateral centre region of the bell may extend for at least 50% of the length of the tubular wall. This assists to prevent turbulence in the centre of the bore of the tubular wall where a user holds the bell.

In some embodiments the outer surface of the tubular wall generally slopes inwardly towards the lateral centre line of the dumbbell, for example as shown in FIG. 4. By sloping the tubular wall inwards an angle between the lateral fin 30 and the outer surface of the wall 15 can be increased for a given lateral fin angle relative to the longitudinal centre line of the bell. An increased angle between the wall and lateral fin may increase resistance for a given outward fin angle by increasing the surface area presented by the bell to movement along the longitudinal axis of the bell. An increased angle between the wall and lateral fin may increase resistance for a given outward fin angle by containing a larger volume of water in the containment zone between the lateral fin and outer surface of the wall between two longitudinal fins.

In some embodiments the rod 17 forming the handle of the bell is hollow and has openings 25 to allow water to flood into an inside of the rod. This reduces buoyancy of the bell. In some embodiments the bell may be approximately neutrally buoyant in the water so that force required to move the bell through water is determined by resistance provided by the surfaces of the bell and not buoyancy, or buoyancy force is small compared to resistance force due to movement through water. In some embodiments, buoyancy force of water acting on the bell (positive or negative) is substantially less than the resistance force provided by the water against surfaces of the bell due to movement of the bell through water. Where the buoyancy of the bell is approximately neutral, the force required to move the bell through water is predominantly dictated by the shape of the bell so that movement of the bell in opposite directions at different height elevations in the water is approximately the same. This provides for balanced forces during use. However, in some embodiments the rod 17 may provide a sealed cavity so that the bell is positively buoyant so that the bell floats to be retrievable from the surface of the water.

In the illustrated embodiment the tubular perimeter wall has a hexagonal lateral cross section. In some embodiments, the lateral cross section of the bell may be circular, or another regular polygon. Preferably the lateral cross section of the bell is circular or is a regular polygon having at least four sides. Where the cross section is a regular polygon preferably the regular polygon has more than four sides.

A bell configured as described is particularly useful in water for aerobic conditioning, strength training, improving cardiovascular endurance and increasing flexibility. The bell may be used by elderly people, pregnant woman or others who particularly benefit from exercising in water. However, a bell configured as described is also particularly useful for fitness enthusiasts, from top athletes both professional and amateur, and beginners or amateur sports men and woman. A bell according to the present invention is lightweight and compact while creating a 10 to 12 times increase in resistance against movement. Although a bell according to the present invention may be made in a range of different dimension and incorporating some or all of the features described above to achieve a desired level of resistance, a preferred set of dimensional information is provided below by way of example.

In some embodiments an overall length of the tubular wall is similar to a maximum diameter or lateral dimension of the bore. Where the lateral fins are angled inwardly, with the overall length of the tubular wall being similar to a maximum diameter or lateral dimension of the bore, lines of outer edges or surfaces of the bell when projected around the bell approximate an outer spherical shape, causing the bell to have a ball or spherical like appearance.

In some embodiments the tubular wall has a length 61 of about 50 mm to 250 mm, or about 80 mm to 220 mm, or about 100 mm to 200 mm, or about 130 mm to 170 mm. In a preferred exemplary embodiment the wall has a length of about 160 mm. In some embodiments the bore has a minimum lateral dimension (for example a diameter or measurement across corners of a polygon) of greater than 120 mm. In some embodiments the bore has a maximum lateral dimension 62 of about 130 mm to 250 mm or about 140 mm to 200 mm, or about 150 mm to 180 mm. In a preferred exemplary embodiment the wall has a maximum lateral dimension of about 160 mm.

In some embodiments the longitudinal fins have a maximum height 63 of about 20 mm to 60 mm, or about 30 mm to 50 mm. In some embodiments the longitudinal fins have a maximum height of about 45 mm. In some embodiments the lateral fins have a maximum height 64 of about 15 mm to 50 mm or about 20 mm to 40 mm. In some embodiments the lateral fins have a maximum height of about 32 mm. In some embodiments the opening between the lateral fin and the tubular wall has a maximum height 65 of about 5 mm to 20 mm, or about 10 mm to 20 mm, or about 15 mm. In some embodiments the holes 37 near ends of the tubular wall have a maximum dimension of about 10 to 20 mm, or about 15 mm. In some embodiments the holes 37 are located less than 20 mm from an end of the bell, or less than 15 mm from an end of the bell.

Preferably the bell or bell parts are formed from plastic material. Preferably the bell is injection moulded from plastic. Example plastic materials are Acrylonitrile Butadiene Styrene, polycarbonate, high-density polyethylene, low density polyethylene, polypropylene, poly-vinyl chloride, ethylene-vinyl acetate or any other suitable plastics material. In a preferred embodiment the bell is injection moulded from Acrylonitrile Butadiene Styrene.

An aqua leg or arm fin assembly (or 'fin') according to some embodiments of one invention is illustrated in FIGS. 7A to 13. The fin may be attached to a user's leg below the knee, to provide resistance against movement of the user's leg through water. Typically a user will wear a leg fin on each leg. Alternatively a user may wear the fin on the user's forearm. The fin is particularly useful for strengthening or otherwise conditioning a person's legs or body, and for improving aerobic conditioning, cardiovascular endurance and increasing flexibility.

A fin assembly 110 according to the present invention comprises at least two separate fin components 111. In use the fin components are secured to a user's limb side-by-side, for example a user's leg as shown in FIGS. 11A to 12B. The fin components provide resistance against movement of the user's limb through water.

The fin components are secured to a user's leg or arm by a fastening member such as a strap. The strap may comprise fasteners for securing ends of the strap together. For example, the strap may have hook and loop fasteners for securing an end of the strap doubled over onto itself after passing through a buckle at an opposite end of the strap.

An example preferred fin component is illustrated in FIGS. 7A to 10B. As illustrated, in some embodiments the fin component comprises a base 115 adapted to fit against the user's limb and at least two longitudinal fins 120 and at least one lateral fin 130 on an outer side of the base 111. The base, longitudinal fins and lateral fin are integrally formed as a single unitary component. The relative positions of the longitudinal fins, lateral fin or fins and base are fixed. To fit against a user's leg preferably the base is curved when viewed in a plan view. The base is adapted to be secured to the user's limb by the fastening member 141. In preferred embodiments, the base comprises slots 140 that receive the strap 141 through the slots 140 to hold the fin component to the user's limb. In use with the fin assembly 110 secured to a user's leg, the longitudinal fins 120 of each fin component 111 extend along the user's limb, and the lateral fin or fins 130 extend lateral to the longitudinal fins, for example as shown in FIGS. 11A to 12B. In some embodiments the longitudinal fins extend substantially the full length of the base 115.

Figure 8B:
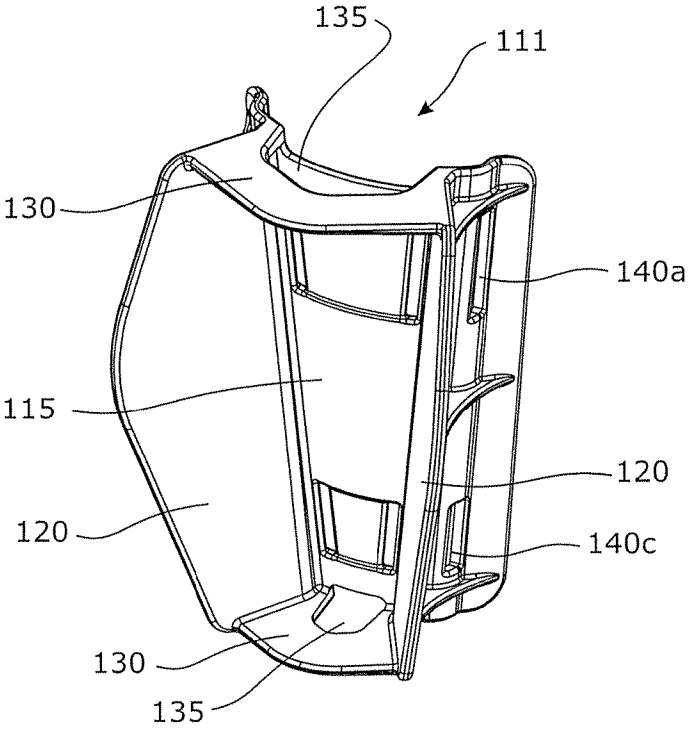
FIG. 8B is a perspective view of a fin component from the assembly of FIG. 7A viewed from an outer side of the component.
Figure 8A:
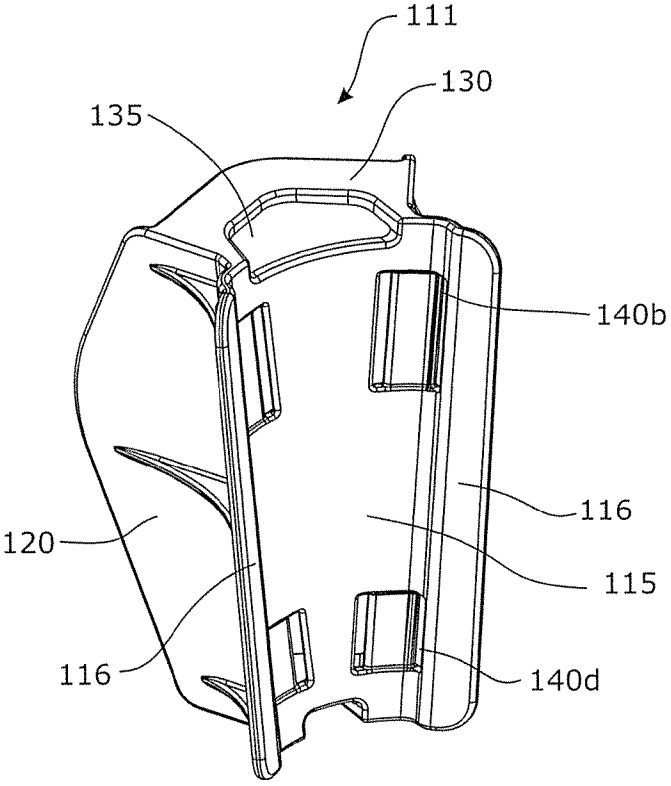
FIG. 8A is a perspective view of a fin component from the assembly of FIG. 7A viewed from an inner side of the component.
Figure 9B:
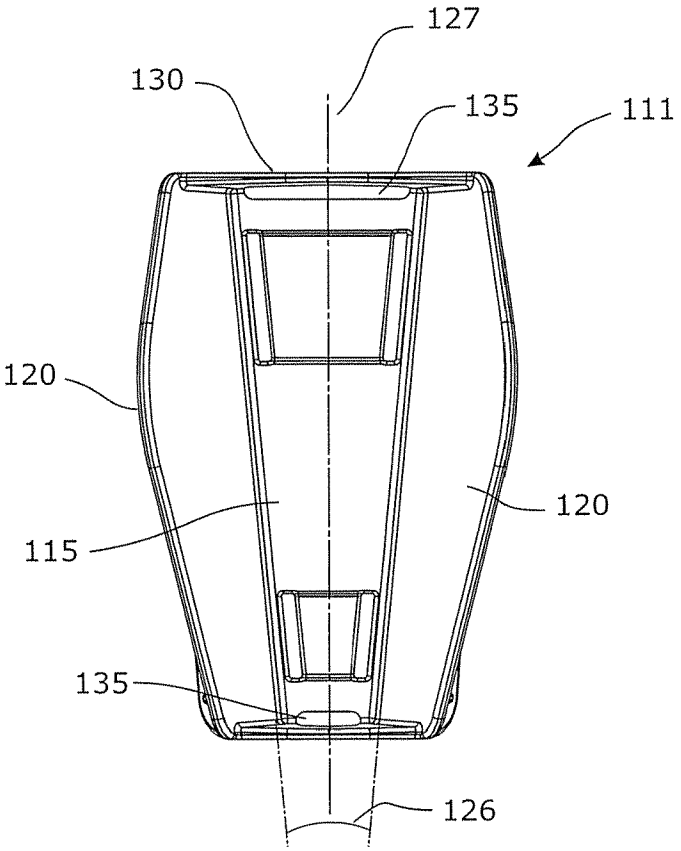
FIG. 9B is a side view of a fin component from the assembly of FIG. 7A viewed from an outer side of the component.
Figure 9A:
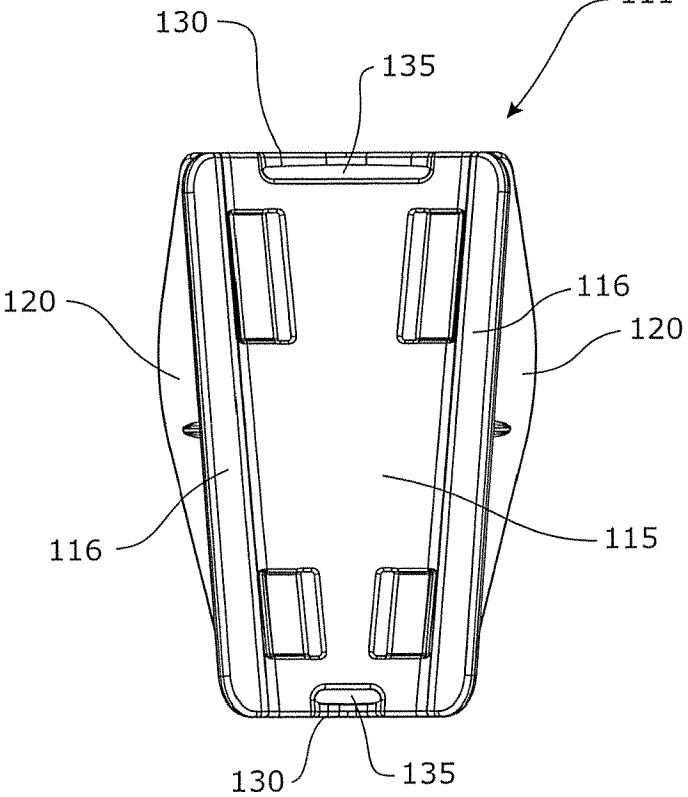
FIG. 9A is a side view of a fin component from the assembly of FIG. 7A viewed from an inner side of the component.

In some embodiments, the base 115 comprises a said slot 140 adjacent each longitudinal edge of the fin component. For example, in some embodiments as illustrated in FIGS. 8A and 8B, the base 115 of the fin component extends laterally outside the inner periphery 121 of the longitudinal fins 120 such that longitudinal fins extend from the base inside of a longitudinal edge of the base, and the slots 140 are positioned in the base laterally outside of the inner periphery of the longitudinal fins. Slots 140*a* and 140*b* form a pair of slots for receiving the fastening member 141. In a preferred embodiment, there are two pairs of slots, 140*a*, 140*b* and 140*c*, 140*d*, each pair of slots for receiving a fastening member. Thus in some embodiments the fin assembly comprises two fastening members 140 axially spaced apart along the length of the fin components 111. Preferably the base 115 of each fin component 111 is secured to the user's limb by the fastening member or members 140 substantially against movement relative to the user's limb in use.

In some embodiments the base has standoff portions 116 that can assist to hold a majority of the base away from the user's limb in use. The standoff portions may reduce the contact area of the base against the user's limb, or can concentrate the contact pressure of the fin component against the user's limb for a given force in the straps 141 securing the fin components to the user's leg to a contact area of the standoff portions. This may provide for a more secure attachment of the fin component to the user's leg. The standoff portions may be portions of the base that are stepped inwardly relative to a centre of curvature of the base. In the illustrated embodiment each standoff portion is a perimeter portion at each longitudinal edge of the base that is stepped inwardly relative to the centre of curvature of the base.

Preferably the base of the fin component is tapered to at least loosely approximate the shape of a limb of a user. For example, where the base 115 is curved and the fin component is tapered, in some embodiments the radius of curvature of the base 115 reduces along the length of the base from one end of the base to the other. For example, where the fin assembly is adapted to be fitted to a user's lower leg the radius of curvature of the base reduces from an upper end of the base to a lower end of the base. The terms 'upper' and 'lower' are relative terms with reference to the fin component in an in-use orientation fitted to the user's leg with the user in a standing position.

Figure 11B:
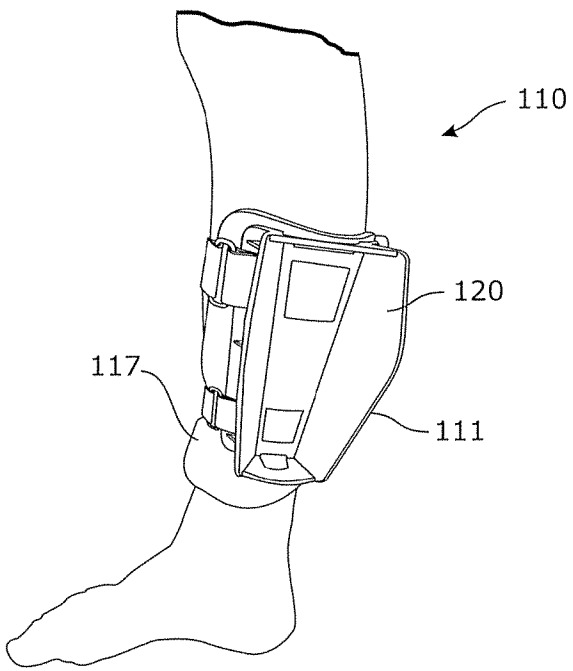
FIGS. 11A and 11B illustrate the leg fin of FIG. 7A being worn by a user in a side-by-side configuration.
Figure 11A:
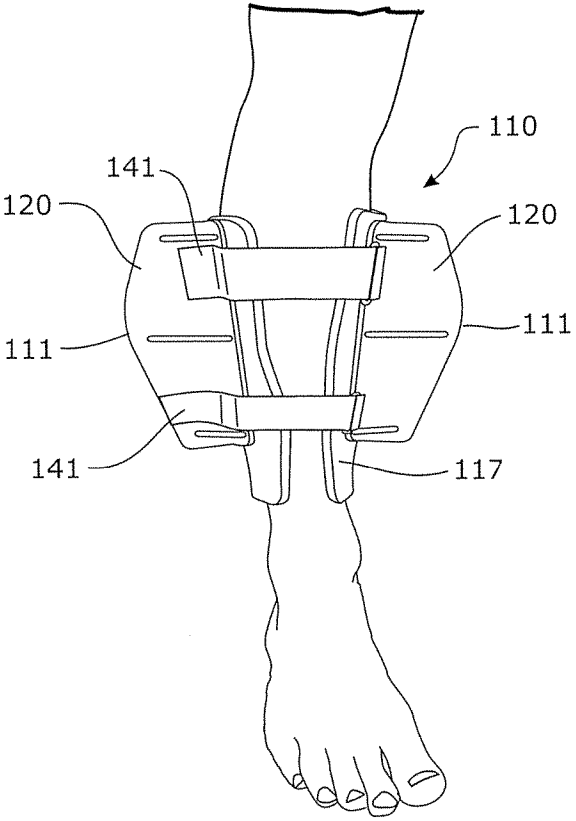
Figure 12B:
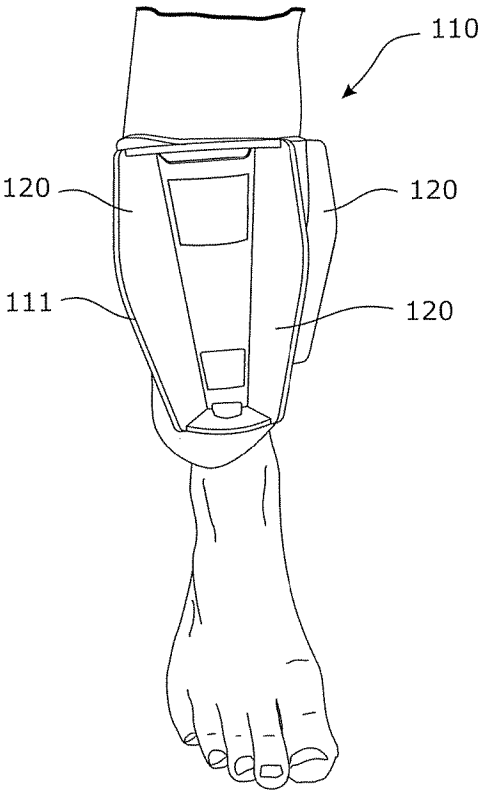
FIGS. 12A and 12B illustrate the leg fin of FIG. 7A being worn by a user in a front-and-back configuration.
Figure 12A:
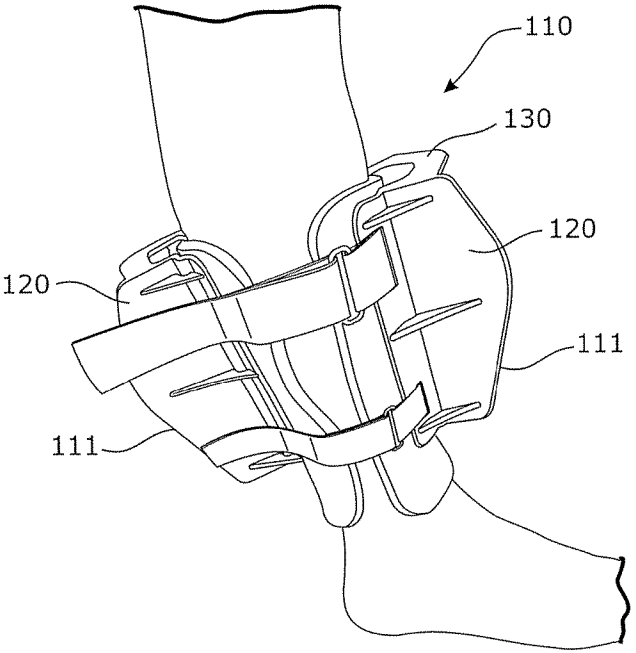

In some embodiments the fin components are moveable on the fastening member 140 prior to fitting the fin assembly 110 to the user's limb, to adjust and set the relative position of the two fin components 111 around the user's limb when fitted for use. This allows the fin assembly to conveniently be fitted to different sized users. The arrangement allows for the assembly to be easily configured to be used by different users. Furthermore, the fin components 111 may be arranged to be on opposed sides of the user's leg, for example as shown in FIGS. 11A and 11B, or with one fin component arranged to a front of a users leg and the other fin component to a rear of the user's leg, as shown in FIGS. 12A and 12B. The arrangement shown in FIG. 11A may be preferred for increased resistance in forward and rearward movement of a user's legs in water, for example when performing a front kicking motion, or a cycling motion. In FIGS. 12A and 12B, the longitudinal fins are arranged predominantly laterally with respect to a forward and rearward movement of a user's leg. However, the arrangement of FIGS. 12A and 12B may also be preferred in forward/rearward movement of the user's legs as the fin components do not protrude sideways from the user's legs as much as when being worn at the sides of a user's leg. Therefore, in the front-and-back configuration of FIGS. 12A and 12B, with a fin assembly worn on each leg, the left leg and right leg fin assemblies are less likely to clash or collide when moving legs forwardly and rearward in water.

In some embodiments the base of the fin component is sized to extend around the user's limb by less than 180 degrees. This allows two fin components to be adjusted around the user's limb to set the relative positions of the fin components as desired. In use, with the fin components set for example as shown in FIGS. 11A to 12B, the lateral distance between the longitudinal fins of a fin component is less than the lateral distance between the longitudinal fins of one fin component and the longitudinal fins of the other fin component. In some embodiments the fin component is adapted to extend around the user's limb by less than 150 degrees, or in some embodiments less than 120 degrees.

By having two or more longitudinal fins 120 on a fin component 111, the lateral distance between the longitudinal fins on a fin component is fixed. However, having more than one fin component in the fin assembly allows the lateral distance between the longitudinal fins on adjacent fin components to be adjusted. This allows the user to set the relative positions of the fin components around the leg while not altering the set configuration of the fins at a fin component.

Figure 10A:
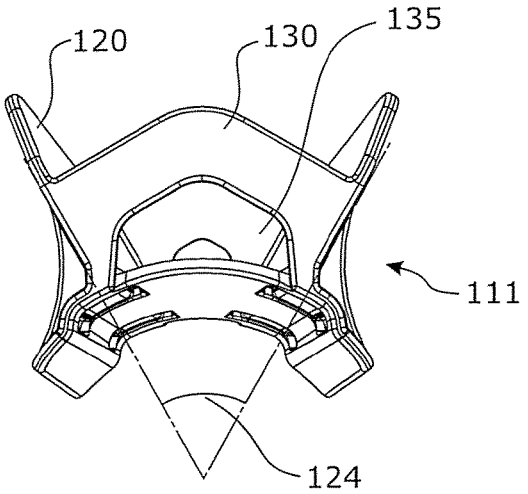
FIG. 10A is a top view of a fin component from the assembly of FIG. 7A.
Figure 10B:
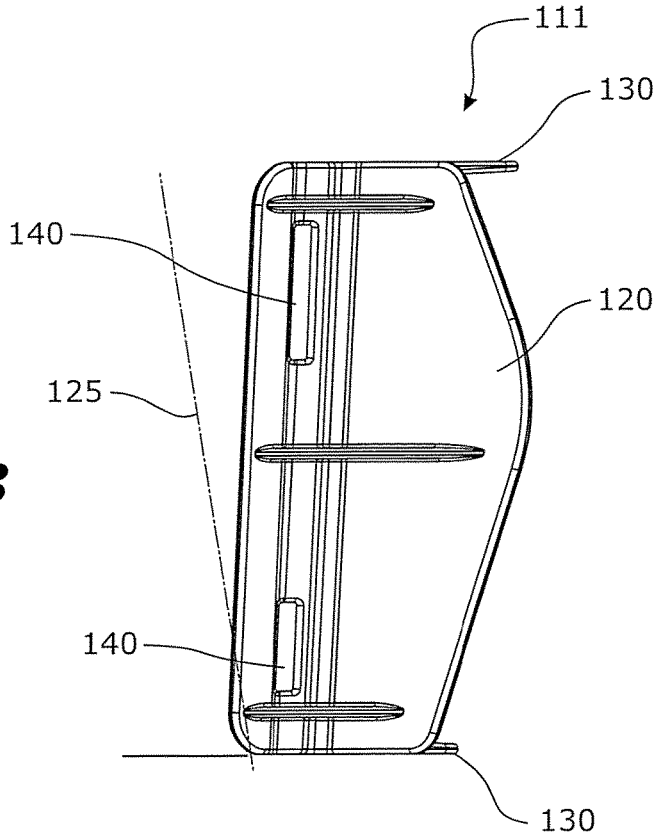
FIG. 10B is a side view of a fin component from the assembly of FIG. 7A.

In some embodiments the longitudinal fins 120 extend outwardly from the base approximately radially relative to an axis that extends along the user's limb. An axis extending along the user's limb is intended to mean an axis that extends substantially along the user's limb, for example within the user's limb, rather than across the user's limb. Unless otherwise indicated, extending outwardly and radially means that a lateral cross section of the longitudinal fin is aligned approximately radially relative to an axis extending along the user's limb, wherein the plane of the lateral cross section is arranged lateral to a longitudinal axis of the fin component. The axis from which the longitudinal fins extend radially may be referred to as the 'radial axis' of the longitudinal fins. In some embodiments the longitudinal fins 120 converge from one end of the base 115 to another end of the base, so that the fins follow approximately the taper of a user's limb. In such an embodiment, the distance from the base 115 to the radial axis of the longitudinal fins reduces along the length of the fin component 111. For example, as illustrated in FIG. 10B, where the fin component is tapered to fit to a user's lower leg, the distance from the base 115 to the radial axis 125 of the longitudinal fins 120 reduces from an upper end of the base to a lower end of the base.

In some embodiments the radial axis may extend approximately along the centre of curvature of the base of the fin component. In such an embodiment the longitudinal fins extend approximately radially from the curved base 115. In some embodiments, the radial axis of the longitudinal fins 120 and the centre of curvature of the base are different. In some embodiments the radial axis of longitudinal fins is closer to the base than the centre of curvature of the base. This has the effect of bringing the longitudinal fins laterally closer together for a given angle between the longitudinal fins.

In some embodiments the longitudinal fins extend radially from an axis extending along the limb of the user with an angle 124 (FIG. 10A) between the longitudinal fins of between 40 and 80 degrees. In some embodiments the angle 124 between the longitudinal fins is between 50 and 70 degrees. In some embodiments the angle between the fins is about 60 degrees. In some embodiments the lateral cross sections of the longitudinal fins are parallel.

In some embodiments the longitudinal fins are arranged to be positioned within an arc length subtending an angle of less than 90 degrees with respect to an approximate longitudinal centreline of the user's limb (for example the lower leg of a user). This arrangement provides fin components with multiple longitudinal fins to be positioned on a user's limb so that the longitudinal fins remain within a quadrant of a circumference of the user's limb. This arrangement may ensure the longitudinal fins are arranged predominantly forward or rearward or to a side of the user's limb depending on the position of the fin component on the user's limb.

In some embodiments the longitudinal fins are arranged to be positioned within an arc length subtending an angle of 30 degrees to 90 degrees with respect to an approximate longitudinal centreline of the user's limb, or 40 to 80 degrees, or 50 to 70 degrees with respect to an approximate longitudinal centreline of the user's limb. In the illustrated embodiment the longitudinal fins are arranged within an arc length subtending an angle of about 60 degrees with respect to an approximate longitudinal centre line of a typical adult user's lower leg. A person skilled in the art will understand that the angle relative to the centreline of a user's limb depends on the size of a user's limb. Therefore with the illustrated embodiment fitted to a person with a larger leg the longitudinal fins will be positioned within an arc length subtending an angle of less than 60 degrees.

Preferably the longitudinal fins 120 converge from one end of the base 115 to another end of the base, so that the fins follow approximately the taper of a user's limb, for example the taper of a user's shin or lower leg. In some embodiments the longitudinal fins converge at an angle of convergence 126 (FIG. 9B) of about 6 degrees to 16 degrees, or about 8 degrees to 14 degrees or about 10 degrees to 12 degrees. Preferably the fin component is symmetrical with respect to a plane of symmetry located at a longitudinal centre line 127 (FIG. 9B) of the fin component. Preferably the longitudinal fins 120 are laterally spaced apart at the base of the fin component 111. For example, two outer most longitudinal fins may be spaced apart by a maximum lateral spacing of about 40 mm to 60 mm or about 50 mm to 60 mm at one end of the fin component at an outer surface of the base. There may be additional longitudinal fins located in between the two outermost longitudinal fins.

The longitudinal fins provide resistance against movement of a user's limb in a lateral direction relative to the limb, for example a forward kicking motion of a user's leg, or a side swinging motion of a user's leg. The fin components also comprise at least one lateral fin 130 to provide resistance against movement of the user's limb in a direction along the user's limb, for example in a stepping or jogging motion of the user's legs, or a punching motion of the user's arm. For example, the fin component 111 may comprise a single lateral fin 130 extending between the longitudinal fins. In the preferred embodiment the fin component comprises two lateral fins 130 spaced axially apart along a longitudinal axis of the fin component as illustrated. The lateral fins may span or bridge between two longitudinal fins 120, for example as illustrated. In some embodiments each lateral fin is positioned adjacent an end of the fin component 111. In some embodiments the lateral fins are substantially parallel and perpendicular to a longitudinal centerline 127 of the fin component.

In some embodiments an opening 135 is provided between the lateral fin and an outer surface of the base 115 of the fin component 120. In some embodiments the opening spans substantially fully between adjacent longitudinal fins. In use, when the fin assembly is moved longitudinally, the lateral fins provide resistance. However, the opening 135 allows water to pass the lateral fin on either side of the lateral fin on the outside of the base.

With two spaced apart lateral fins 130, the lateral fins and longitudinal fins 120 provide a containment volume at an outer surface of the base. The containment volume is defined by a boundary wall formed by the two spaced apart lateral fins and two spaced apart longitudinal fins. The containment volume acts to partially contain or hold or restrict a volume of water therein as the fin assembly is moved through the water, to add resistance or weight to the movement. Openings 135 may be provided to affect the amount of movement of water over the outer surface of the base and thus affect the resistance provided by the fin assembly against movement. With the fin components worn in a front and back configuration as shown in FIGS. 12A and 12B, the lateral fins and longitudinal fins may combine to 'cup' or restrict movement of water around the user's limb when moving the lower leg in the forward and backward direction.

Preferably the fin assembly 110 comprises a cushion 117. In some embodiments the fin components are moveably attached to the cushion so that the relative position of the fin components is adjustable as described earlier. Preferably the fin components are attached to the cushion by the fastening member. That is the same fastening member or members are used to hold the cushion and fin components together in the fin assembly and secure the cushion and fin components to the user's limb in use. In some embodiments the cushion is formed from neoprene. The neoprene thickness may be about 5 mm to 20 mm, or 5 mm to 15 mm or 7 mm to 13 mm. In some embodiments the thickness of the neoprene is chosen to provide some buoyancy so that additional effort is required to force the fin assembly downwards in the water during use. To provide a functional amount of buoyancy the neoprene cushion may have a thickness of greater than 7 mm.

A limb fin assembly configured as described is particularly useful in water for aerobic conditioning, strength training, improving cardiovascular endurance and increasing flexibility. The limb fin may be used by elderly people, pregnant woman or others who particularly benefit from exercising in water. However, a fin assembly configured as described is also particularly useful for fitness enthusiasts, from top athletes both professional and amateur, and beginners or amateur sports men and woman. A fin assembly according to the present invention is lightweight and compact while providing a functional level of resistance against movement. Although a leg fin assembly according to the present invention may be made in a range of different dimension and incorporating some or all of the features described above to achieve a desired level of resistance, a preferred set of dimensional information is provided below by way of example.

In some embodiments the fin component is about 100 to 200 mm long. For example the fin component is about 150 to 180 mm long. As described earlier preferably the base does not extend about a user's limb by more than 180 degrees. In some embodiments the base has a maximum with of about 100 mm. For example, where the base is tapered to fit a user's leg below the knee, an upper end of the base may have a width of about 80 to 120 mm and a lower end of the base may have a width of about 60 to 100 mm.

In some embodiments the width of the upper end of the base may be about 100 mm and the width of a lower end of the base may be about 80 mm. In some embodiments the two outer most longitudinal fins may be spaced apart by a maximum lateral spacing of about 40 mm to 60 mm or about 50 mm to 60 mm at one end of the fin component at an outer surface of the base. For example, where the longitudinal fins converge to approximately follow a taper of the user's limb, the lateral spacing between the longitudinal fins at one end of the base may be about 50 mm to 60 mm at the outer surface of the base, and at an opposite end about 25 mm to 35 mm. In some embodiments the longitudinal fins have a maximum height of about 20 mm to 100 mm, or about 30 mm to 80 mm or about 30 mm to 70 mm. In some embodiments lateral fins have a maximum height of about 15 mm to 40 mm or about 20 mm to 30 mm. In some embodiments the opening between the lateral fin and the outer surface of the base has a maximum height of about 5 mm to 30 mm, or about 10 mm to 25 mm.

Preferably the fin component is formed from plastics material. Preferably the fin component is injection moulded from plastic. Example plastic materials are Acrylonitrile Butadiene Styrene, polycarbonate, high-density polyethylene, low density polyethylene, polypropylene, poly-vinyl chloride, ethylene-vinyl acetate or any other suitable plastics material.

The limb fin assembly has been described for use by a person. However, a leg fin according to the present invention may be applied for use by animals. For example, a fin assembly according to the present invention may be applied in equestrian training in water. In particular, the leg fin assembly may be fitted to a horse below the knee in the front and back configuration illustrated in FIGS. 12A and 12B. This configuration is particularly useful in that horses can become 'spooked' with an attachment fitted to the leg that protrudes laterally relative to forward and rearward movement of the horse's legs. The particular arrangement of the leg fin of the present invention allows for the fins to be presented predominantly forward and rearward which may make the fin assembly particularly useful in equestrian training.

The foregoing description of the invention includes preferred forms thereof. Modifications may be made thereto without departing from the scope of the invention as defined by the accompanying claims.

The invention claimed is:

1. An aqua resistance dumbbell comprising:

a tubular wall providing a bore for receiving a user's hand from each end of the dumbbell, a rod located within the bore and extending laterally across the bore to be gripped by a user with one or both hands from one or both ends of the bore, a plurality of longitudinal fins extending along the tubular wall on an outer side of the tubular wall, and at least one lateral fin on the outer side of the tubular wall, the at least one lateral fin extending laterally at least part way around the tubular wall.

2. The dumbbell as claimed in claim 1, wherein the longitudinal fins extend substantially radially with respect to a longitudinal axis of the bore, and/or are aligned substantially parallel to a longitudinal axis of the bore.

3. The dumbbell as claimed in claim 1, wherein an inner surface of the bore is substantially smooth without fins to provide a substantially unobstructed bore for receiving a user's hand from each end of the dumbbell.

4. The dumbbell as claimed in claim 1, wherein the tubular wall is without holes in a lateral centre region of the tubular wall.

5. The dumbbell as claimed in claim 1, wherein the rod is located substantially on a lateral centre line of the dumbbell.

6. The dumbbell as claimed in claim 5, wherein an inner surface of the tubular wall generally slopes inwardly towards the lateral centre line of the dumbbell, such that an internal lateral dimension of the bore at the lateral centre line of the bell is smaller than at ends of the bore.

7. The dumbbell as claimed in claim 1, wherein the at least one lateral fin extends laterally fully around the tubular wall.

8. The dumbbell as claimed in claim 1, wherein each lateral fin bridges between adjacent longitudinal fins.

9. The dumbbell as claimed in claim 1, wherein a plurality of openings is provided around the tubular wall between the lateral fin and the outside of the tubular wall.

10. The dumbbell as claimed in claim 1, wherein an opening is provided between each lateral fin and an outside surface of the tubular wall between each pair of adjacent longitudinal fins.

11. The dumbbell as claimed in claim 10, wherein each opening spans substantially fully between adjacent longitudinal fins.

12. The dumbbell as claimed in claim 1, the dumbbell comprising two lateral fins spaced axially apart along a longitudinal axis of the bore, one said lateral fin on one side of a lateral centre line of the dumbbell and the other said lateral fin on an opposite side of the lateral centre line.

13. The dumbbell as claimed in claim 12, wherein the lateral fins are symmetrical with respect to a plane of symmetry located at a lateral centre line of the bell extending perpendicular to the longitudinal axis of the bell.

14. The dumbbell as claimed in claim 12, each lateral fin positioned adjacent an end of the dumbbell.

15. The dumbbell as claimed in claim 12, wherein the two lateral fins and two adjacent longitudinal fins provide a boundary wall to define a containment volume at an outer surface of the tubular wall, the plurality of longitudinal fins and spaced apart lateral fins defining a plurality of containment volumes spaced apart around the tubular wall.

16. The dumbbell as claimed in claim 12, wherein the lateral fins are angled inwardly towards a lateral centre line of the bell.

17. The dumbbell as claimed in claim 1, wherein the tubular wall of the dumbbell comprises holes adjacent each end of the dumbbell spaced apart around the perimeter of the tubular wall.

18. The dumbbell as claimed in claim 1, wherein the rod is hollow with openings to allow water to flood into an inside of the rod.

19. The dumbbell as claimed in claim 1, wherein an overall length of the tubular wall is similar to a maximum diameter or lateral dimension of the bore.

20. The dumbbell as claimed in claim 1, wherein the longitudinal fins extend the full length of the tubular wall.

* * * * *